US009816522B2

(12) United States Patent
Zheng et al.

(10) Patent No.: US 9,816,522 B2
(45) Date of Patent: Nov. 14, 2017

(54) CENTRIFUGAL COMPRESSOR HAVING AN ASYMMETRIC SELF-RECIRCULATING CASING TREATMENT

(75) Inventors: Xinqian Zheng, Beijing (CN); Yun Lin, Beijing (CN); Yangjun Zhang, Beijing (CN); Mingyang Yang, Beijing (CN); Takahiro Bamba, Tokyo (JP); Hideaki Tamaki, Tokyo (JP)

(73) Assignees: IHI CORPORATION, Tokyo (JP); TSINGHUA UNIVERSITY, Beijing (CN)

( * ) Notice: Subject to any disclaimer, the term of this patent is extended or adjusted under 35 U.S.C. 154(b) by 599 days.

(21) Appl. No.: 13/578,188

(22) PCT Filed: Feb. 3, 2011

(86) PCT No.: PCT/JP2011/052274

§ 371 (c)(1),
(2), (4) Date: Aug. 9, 2012

(87) PCT Pub. No.: WO2011/099419

PCT Pub. Date: Aug. 18, 2011

(65) Prior Publication Data

US 2012/0315127 A1 Dec. 13, 2012

(30) Foreign Application Priority Data

Feb. 9, 2010 (CN) ..... 2010 1 0110299
Feb. 9, 2010 (CN) ..... 2010 1 0110311

(51) Int. Cl.
*F04D 17/16* (2006.01)
*F04D 29/42* (2006.01)
*F04D 29/68* (2006.01)

(52) U.S. Cl.
CPC ..... *F04D 29/4213* (2013.01); *F04D 29/685* (2013.01)

(58) Field of Classification Search
CPC ..... F04D 29/4213; F04D 29/685
(Continued)

(56) References Cited

U.S. PATENT DOCUMENTS 4,930,979 A 6/1990 Fisher et al.
4,990,053 A * 2/1991 Rohne ..... 415/58.4
(Continued)

FOREIGN PATENT DOCUMENTS

JP 02-042199 2/1990
JP 3001902 B2 1/2000
(Continued)

OTHER PUBLICATIONS

International Search Report issued in related application PCT/JP2011/052269, completed Apr. 18, 2011 and dated Apr. 26, 2011.
(Continued)

*Primary Examiner* — Woody Lee, Jr.
*Assistant Examiner* — Jesse Prager
(74) *Attorney, Agent, or Firm* — Griffin and Szipl PC

(57) ABSTRACT

A centrifugal compressor has a casing 7. In the casing 7 is formed a back-flow channel 9 to return fluid from a downstream position of an impeller full blade leading edge 6*a* to an upstream position of the impeller full blade leading edge 6*a*. The back-flow channel 9 includes a suction ring groove 9*a* and a back-flow ring groove 9*b*. The suction ring groove opens at the downstream position on the inner face 7*a* of the casing 7, and extends in the circumferential direction. The back-flow ring groove opens at the upstream position on the inner face 7*a*, and extends in the circumferential direction. Distribution in the circumferential direction of the axial-direction position of the suction ring groove 9*a* or a width of the suction ring groove 9*a* is asymmetric with reference to the rotation axis.

4 Claims, 6 Drawing Sheets

(58) Field of Classification Search
USPC ..... 415/58.4, 58.6, 203, 206, 58.3, 914
See application file for complete search history.

(56) References Cited

U.S. PATENT DOCUMENTS

| | | | | |
|---|---|---|---|---|
| 5,333,990 | A * | 8/1994 | Foerster et al. | 415/58.4 |
| 6,290,458 | B1 * | 9/2001 | Irie et al. | 415/119 |
| 7,229,243 | B2 | 6/2007 | Nikpour et al. | |
| 7,364,404 | B2 * | 4/2008 | Guemmer | 416/91 |
| 7,604,457 | B2 * | 10/2009 | Xu | F04D 29/422 415/206 |
| 7,645,121 | B2 * | 1/2010 | Tudor | 415/220 |
| 2005/0008484 | A1 | 1/2005 | Nikpour et al. | |
| 2008/0044273 | A1 * | 2/2008 | Khalid | 415/57.4 |
| 2008/0199306 | A1 * | 8/2008 | Lebret | 415/131 |
| 2009/0290974 | A1 | 11/2009 | Bayere et al. | |
| 2010/0014956 | A1 * | 1/2010 | Guemmer | 415/9 |
| 2015/0056062 | A1 | 2/2015 | Tamaki | |

FOREIGN PATENT DOCUMENTS

| | | | |
|---|---|---|---|
| JP | 2001-263296 | A | 9/2001 |
| JP | 2003-106299 | | 4/2003 |
| JP | 2004-332734 | A | 11/2004 |
| JP | 2007-127109 | A | 5/2007 |
| JP | 2007-224789 | A | 9/2007 |
| JP | 4100030 | B2 | 6/2008 |
| JP | 4107823 | B2 | 6/2008 |

OTHER PUBLICATIONS

International Search Report issued in related application PCT/JP2011/052272, completed Apr. 18, 2011 and dated Apr. 26, 2011.
International Search Report issued in related application PCT/JP2011/052273, completed Apr. 18, 2011 and dated Apr. 26, 2011.
International Search Report issued in corresponding application PCT/JP2011/052274, completed Apr. 18, 2011 and dated Apr. 26, 2011.
Office Action issued in co-pending related U.S. Appl. No. 13/578,137 dated Mar. 4, 2015.
Office Action issued in co-pending related U.S. Appl. No. 13/578,163 dated Feb. 23, 2015.
Office Action issued in co-pending related U.S. Appl. No. 13/578,101 dated Feb. 10, 2015.
Office Action issued in co-pending related U.S. Appl. No. 13/578,163 dated Jun. 19, 2015.

* cited by examiner

CENTRIFUGAL COMPRESSOR HAVING AN ASYMMETRIC SELF-RECIRCULATING CASING TREATMENT

This is a National Phase Application in the United States of International Patent Application No. PCT/JP2011/052274 filed Feb. 3, 2011, which claims priority on Chinese Patent Application No. 201010110311.5 filed Feb. 9, 2010 and Chinese Patent Application No. 201010110299.8 filed Feb. 9, 2010. The entire disclosures of the above patent applications are hereby incorporated by reference.

TECHNICAL FIELD

The present invention relates to a centrifugal compressor including an asymmetric self-recirculating casing treatment. The centrifugal compressor is used in a turbomachinery for various purposes such as superchargers for vehicles and ships, industrial compressors and aeroengines.

BACKGROUND ART

Although a turbo compressor using a centrifugal compressor has advantages such as having better efficiency, being lighter in weight and being more stable in operation than a reciprocating compressor, their allowable operating range (i.e., the range of the flow rate to a centrifugal compressor) is limited. At a small flow-rate operating point of a centrifugal compressor (i.e., when the flow rate to a compressor is small), phenomena such as considerable fluid separation at the internal flow field occur, thus causing instable operation phenomena and causing stall and accordingly surge. As a result, rapid decrease in the efficiency and the pressure-ratio of the compressor is caused, the life of the compressor is shortened, and accordingly the compressor is damaged in a short time. To cope with this, various countermeasures are taken to delay instable phenomena such as stall of a compressor, extending a stable operating range.

To extend a stable operating range, a casing treatment is provided in a centrifugal compressor. For example, as in Patent Literatures 1 to 5, at an inner face of a casing surrounding an impeller of a centrifugal compressor are formed a suction ring groove that is located downstream of a leading edge of the impeller and a back-flow ring groove that is located upstream of the leading edge of the impeller. With this configuration, when the flow rate to the centrifugal compressor becomes small, fluid in a channel defined at the inner face of the casing is allowed to flow into the interior of the casing from the suction ring groove, and this fluid is returned to the channel upstream of the leading edge of the impeller from the back-flow ring groove. As a result, the flow rate to the impeller is increased, whereby the operation of the centrifugal compressor becomes stable. In this way, a stable operating range can be extended.

CITATION LIST

Patent Literatures

PTL 1: JP 3001902
PTL 2: JP-A-2007-127109
PTL 3: JP 4100030
PTL 4: JP 4107823
PTL 5: U.S. Pat. No. 4,930,979

SUMMARY OF INVENTION

Conventionally, however, non-uniform pressure distribution in the circumferential direction is not considered. That is, a scroll channel as a channel of the fluid that is sent out from an impeller of a centrifugal compressor has an asymmetric shape with reference to the rotational axis (shaft), and therefore the fluid on the outlet side of the centrifugal compressor generates non-uniform pressure distribution in the circumferential direction. This distribution affects the upstream flow field as well, causing asymmetric flow field at the inlet of the centrifugal compressor in the circumferential direction with reference to the rotational axis. In a conventional casing treatment, a suction ring groove symmetric with reference to the rotational axis is formed, and accordingly the asymmetric flow field at the interior of the centrifugal compressor is not considered. That is, the casing treatment cannot be optimized for the entire circumference. Therefore, there is a limit to extend a stable operating range of the centrifugal compressor. In the below, the words "symmetric with reference to the rotational axis" is as "symmetric".

Then, it is an object of the present invention to provide a centrifugal compressor including a casing treatment capable of extending a stable operating range without degrading the efficiency.

In order to fulfill the aforementioned object, a centrifugal compressor having an asymmetric self-recirculating casing treatment of the present invention includes a rotational shaft (3) that is rotated and an impeller (5) fixed to the rotational shaft, the impeller sending out drawn fluid to an outer side of a radial direction of the rotational shaft for compression. The centrifugal compressor includes a casing (7) having an inner face surrounding the impeller. In the casing is formed a back-flow channel (9) to return fluid from a downstream position of an impeller full blade leading edge (6*a*) to an upstream position of the impeller full blade leading edge, and the back-flow channel includes a suction ring groove (9*a*) and a back-flow ring groove (9*b*), the suction ring groove opening at the downstream position on the inner face and formed in a circumferential direction around the rotational shaft, and the back-flow ring groove opening at the upstream position on the inner face and formed in the circumferential direction. A position in an axial direction of the rotational shaft is defined as an axial-direction position, and distribution in the circumferential direction of the axial-direction position of the suction ring groove or a width of the suction ring groove is asymmetric with reference to the rotational shaft.

In the term the "asymmetric self-recirculating casing treatment", "self-recirculating" refers to recirculation of fluid via the back-flow channel, and "asymmetric casing treatment" refers to the configuration where the circumferential-direction distribution of an axial-direction position of the suction ring groove or of the width of the suction ring groove is asymmetric with reference to the rotational shaft.

In the case where the back-flow channel is not provided, fluid pressure distribution becomes non-uniform in the circumferential direction upstream of the impeller full blade leading edge. According to the present invention, the axial-direction position of the suction ring groove or the axial-direction width of the suction ring groove is changed in accordance with circumferential-direction positions so as to reduce the non-uniformity of the fluid pressure distribution.

Advantageous Effects of Invention

According to the aforementioned present invention, the distribution in the circumferential direction of the axial-direction position of the suction ring groove or the axial-direction width of the suction ring groove is asymmetric.

With this configuration, a stable operating range can be further extended without degrading the efficiency.

DESCRIPTION OF EMBODIMENTS

Figure 1:
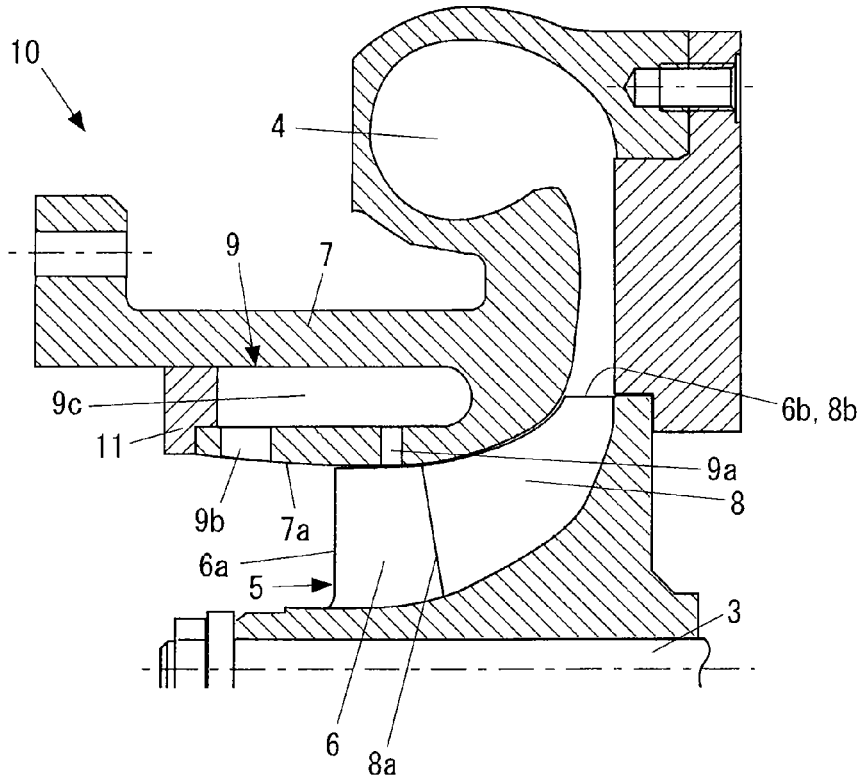
FIG. 1 is a vertical cross-sectional view of a centrifugal compressor according to Embodiment 1 or Embodiment 2 of the present invention.

The following describes embodiments of the present invention with reference to the drawings. In the drawings, the same reference numerals are assigned to common elements, and duplicated description will be omitted.

(Embodiment 1)

FIG. 1 is a vertical cross-sectional view of a centrifugal compressor 10 including an asymmetric self-recirculating casing treatment according to Embodiment 1 of the present invention. The centrifugal compressor 10 includes a rotational shaft 3 that is rotated and an impeller 5 fixed to the rotational shaft 3. The impeller 5 sends out drawn fluid to a scroll channel 4 on the outer side of a radial direction of the rotational shaft 3 for compression. The impeller 5 includes an impeller full blade 6 and an impeller splitter blade 8. In FIG. 1, the reference numeral 6*a* denotes an impeller full blade leading edge, 6*b* denotes an impeller full blade trailing edge, 8*a* denotes an impeller splitter blade leading edge, and 8*b* denotes an impeller splitter blade trailing edge. The leading edge refers to an upstream end, and the trailing edge refers to a downstream end.

In Embodiment 1, the circumferential direction around the rotational shaft 3 is simply called a circumferential direction, a direction in parallel with the rotational shaft 3 is simply called an axial direction, a radial direction of the rotational shaft 3 is simply called a radial direction, a position in the circumferential direction is simply called a circumferential-direction position, and a position in the axial direction is simply called an axial-direction position.

The centrifugal compressor 10 further includes a casing 7 having an inner face 7*a* extending in the circumferential direction so as to surround the impeller full blade 6. In the casing 7 is formed a back-flow channel 9 to return fluid from a downstream position of the impeller full blade leading edge 6*a* to an upstream position of the impeller full blade leading edge 6*a*. In the example of FIG. 1, the downstream position is positioned between the impeller full blade leading edge 6*a* (most upstream position in the axial direction) and the impeller full blade trailing edge 6*b* (most downstream position in the axial direction).

The back-flow channel 9 includes a suction ring groove 9*a*, a back-flow ring groove 9*b* and a ring guide channel (ring guide groove) 9*c*. The suction ring groove 9*a* opens at the downstream position on the inner face 7*a* and extends in the circumferential direction. The suction ring groove 9*a* extends in the radial direction from the opening position into the casing 7. The back-flow ring groove 9*b* opens at the upstream position on the inner face 7*a* and extends in the circumferential direction. The back-flow ring groove 9*b* extends in the radial direction from the opening position into the casing 7. The ring guide channel 9*c* extends in the axial direction so as to communicate the suction ring groove 9*a* with the back-flow ring groove 9*b*. In FIG. 1, the ring guide channel 9*c* is closed by a block member 11.

In Embodiment 1 the "ring" in the suction ring groove 9*a*, the back-flow ring groove 9*b* and the ring guide channel 9*c* refers to a ring shape of them viewed from the axial direction.

Figure 2:
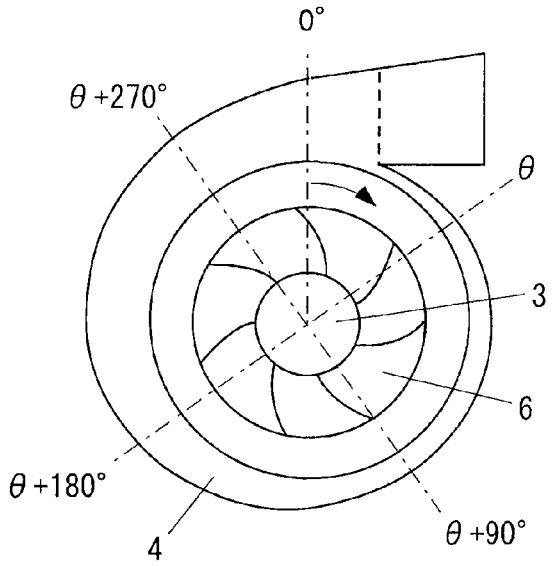
FIG. 2 is a schematic view of the centrifugal compressor of FIG. 1 viewed from an axial direction thereof.

Due to asymmetry of the scroll channel 4 illustrated in FIG. 2, the flow field at the suction ring groove 9*a* does not have symmetry with reference to the rotational shaft 3. Although FIG. 1 illustrates only one side (upper side of FIG. 2) with reference to the rotational shaft 3 as a boundary, FIG. 2 illustrates the rotational shaft 3, the scroll channel 4 and the impeller full blade 6 as a whole viewed from the axial direction. As in FIG. 2, the drawn fluid flowing into the impeller full blade 6 is sent out by the impeller full blade 6 to the scroll channel 4 positioned on the outer side of the radial direction, and flows to the outer side in the radial direction while flowing in the circumferential direction in the scroll channel 4. As in FIG. 2, the scroll channel 4 does not have a symmetric shape. For this reason, the flow field (pressure and flow rate of the fluid) of the fluid also does not have symmetry in the scroll channel 4. Such asymmetric flowing field affects the flow field upstream of the scroll channel 4 as well. As a result, the flow field in the suction ring groove 9*a* also does not have symmetry.

Accordingly, unlike Embodiment 1, in the case of the configuration without the back-flow channel 9, the fluid pressure distribution in the circumferential direction becomes non-uniform at a position (e.g., at the axial-direction position of the suction ring groove 9*a*, an intermediate part in the axial direction of the impeller full blade 6 or the scroll channel 4) downstream of the impeller full blade leading edge 6*a*.

Unlike Embodiment 1, in the case of the configuration with a back-flow channel 9 symmetric with reference to the rotational shaft 3, that is, in the case where the axial-direction positions of the suction ring groove 9*a* of the back-flow channel 9 are constant among the circumferential positions, the fluid pressure distribution in the circumferential direction becomes non-uniform downstream of the impeller full blade leading edge 6*a*.

At a circumferential direction position of a low pressure that is downstream of the impeller full blade leading edge 6*a*, the pressure becomes low also upstream of the impeller full blade leading edge 6*a*. Accordingly, in many cases, the fluid pressure distribution at the position downstream of the impeller full blade leading edge 6*a* is similar to that at the position upstream of the impeller full blade leading edge 6*a*.

According to Embodiment 1, the axial-direction position of the suction ring groove 9*a* has asymmetric distribution in the circumferential direction with reference to the rotational shaft 3.

That is, according to Embodiment 1, the axial-direction positions of the suction ring groove 9*a* at circumferential direction positions are changed in accordance with the circumferential direction positions so as to reduce non-uniformity of the fluid pressure distribution at the position (hereinafter called a pressure-distribution-to-be-modified axial-direction position) in the vicinity of the leading edge 6*a* upstream of the impeller full blade leading edge 6*a*. Herein, the axial-direction position of the back-flow ring groove 9*b* may be the same as the pressure-distribution-to-be-modified axial-direction position or may be upstream of the pressure-distribution-to-be-modified axial-direction position.

The following describes embodiments of the present invention in more detail.

Figure 3A:
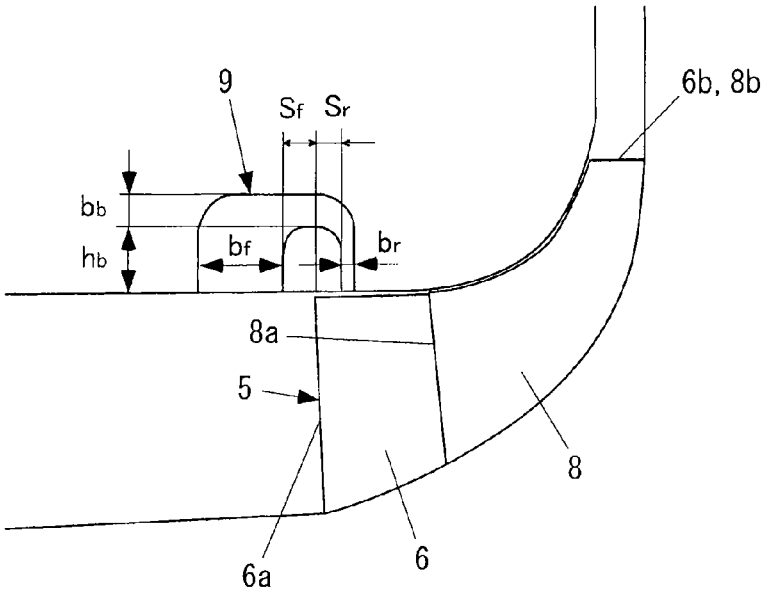
FIG. 3A schematically illustrates parameters of a back-flow channel according to Embodiment 1 or Embodiment 2.
Figure 3B:
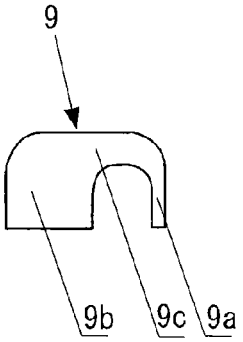
FIG. 3B illustrates the back-flow channel of FIG. 3A.

FIG. 3A illustrates parameters of the back-flow channel 9. FIG. 3B illustrates the back-flow channel of FIG. 3A. $S_r$ corresponds to an axial-direction position of the suction ring groove 9*a*, and is an axial-direction distance (axial distance) from the impeller full blade leading edge 6*a* to the suction ring groove 9*a*. $b_r$ denotes the axial-direction width of the suction ring groove 9*a*. $S_f$ corresponds to an axial-direction position of the back-flow ring groove 9*b*, and is an axial distance from the impeller full blade leading edge 6*a* to the back-flow ring groove 9*b*. $b_f$ denotes the axial-direction width of the back-flow ring groove 9*b*. $b_b$ denotes the radius-direction width of the ring guide channel 9*c*. $h_b$ denotes a depth of the suction ring groove 9*a* or the back-flow ring groove 9*b*.

Among these dimensions, $S_r$ or $b_r$ most affects the stable operating range of the centrifugal compressor 10. That is, among these dimensions, $S_r$ or $b_r$ most affects a pressure difference between the suction ring groove 9*a* and the back-flow ring groove 9*b*, and the flow rate of fluid at the back-flow channel 9.

Then, in Embodiment 1, $S_r$ is adjusted for each circumferential direction position so as to reduce non-uniformity of the fluid pressure distribution in the pressure-distribution-to-be-modified axial-direction position.

Figure 4:
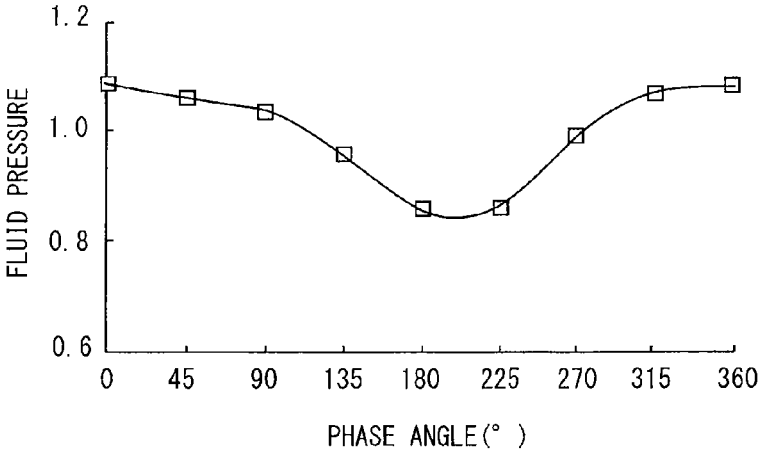
FIG. 4 illustrates an exemplary distribution in the circumferential direction of fluid pressure at a casing inner face.

FIG. 4 illustrates an exemplary fluid pressure distribution of the fluid in the circumferential direction at the pressure-distribution-to-be-modified axial-direction position. In FIG. 4, the horizontal axis represents a phase angle (i.e., circumferential-direction position) around the rotational shaft 3, and the vertical axis represents normalized pressure of fluid. In the example of FIG. 4, open square marks of FIG. 4 represent fluid pressures measured by an experiment. Among the phase angles of FIG. 4, 0° is illustrated in FIG. 2.

Figure 5A:
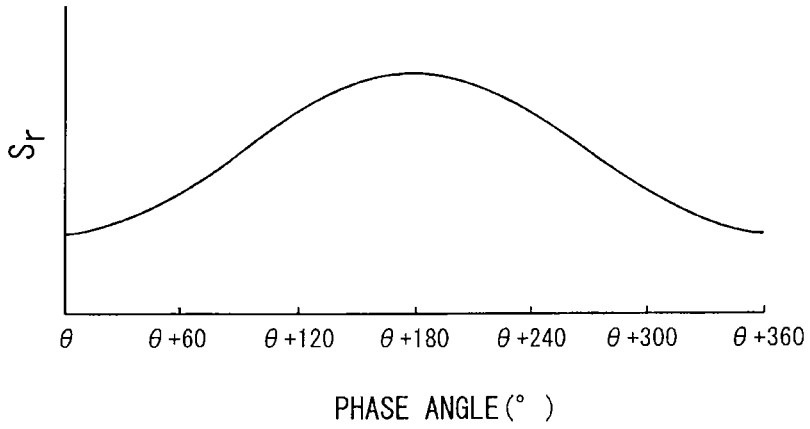
FIG. 5A illustrates distribution of an axial distance $S_r$ of a suction ring groove from an impeller full blade leading edge.

FIG. 5A illustrates the axial-direction positions (i.e., the aforementioned $S_r$) of the suction ring groove 9*a* at the circumferential-direction positions to reduce the non-uniformity of fluid pressure distribution illustrated in FIG. 4. In FIG. 5A, the horizontal axis represents a phase angle (i.e., circumferential-direction position) around the rotational shaft 3, and the vertical axis represents an axial distance $S_r$ from the impeller full blade leading edge 6*a* to the suction ring groove 9*a*. As for the phase angles of FIG. 5A, FIG. 2 illustrates the position of 0° and the position of θ.

During operation when the flow rate to the centrifugal compressor 10 is small, the back-flow channel 9 returns fluid partially from a position downstream of the impeller full blade leading edge 6*a* to a position upstream thereof. Thereby, the flow rate drawn to the impeller full blade 6 is increased. Accordingly the angle of attack of the impeller full blade 6 against the fluid can be decreased, thus preventing phenomena such as fluid separation, stall and surge. As a result, a stable operating range of the centrifugal compressor 10 can be extended.

In Embodiment 1, the suction ring groove 9*a* having $S_r$ as in FIG. 5A reduces the non-uniformity of the fluid pressure distribution in the circumferential direction at the pressure-distribution-to-be-modified axial-direction position, and therefore phenomena such as fluid separation, stall and surge can be prevented more effectively. As a result, a stable operating range of the centrifugal compressor 10 can be more extended.

[Example]

Figure 5B:
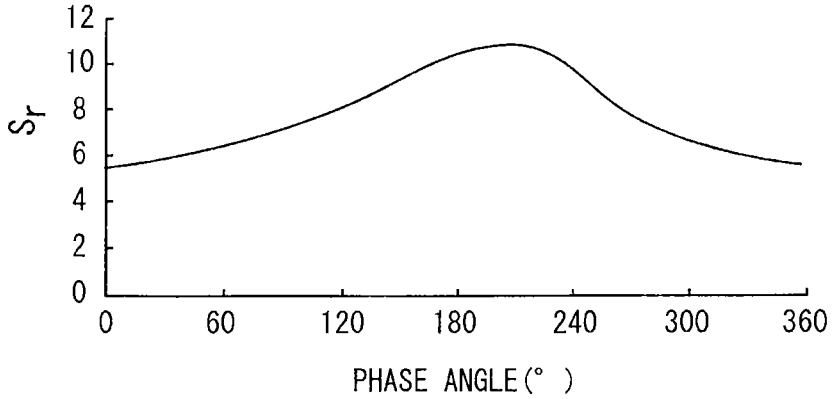
FIG. 5B illustrates optimum distribution of an axial distance $S_r$ of a suction ring groove from an impeller full blade leading edge.

FIG. 5B illustrates optimum distribution of $S_r$ obtained by numerical simulation. In this numerical simulation, the parameters indicating the structure of the back-flow channel 9 are set as $b_r$=4.8 mm, $S_f$=15.0 mm, $b_f$=10.0 mm, $b_b$=13.0 mm, $h_b$=8.0 mm and the starting phase angle θ=0°.

Figure 6A:
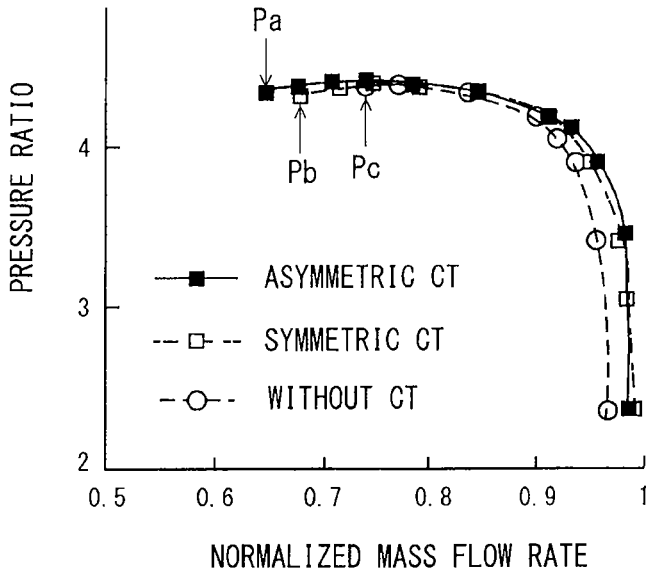
FIG. 6A is a graph for a comparison of pressure ratio among the centrifugal compressor provided with an asymmetric casing treatment according to Embodiment 1, a centrifugal compressor provided with a conventional symmetric casing treatment and a centrifugal compressor without a casing treatment.

FIG. 6A illustrates pressure ratios of the centrifugal compressor with reference to flow rates. In FIG. 6A, the horizontal axis represents normalized values of the flow rates to the centrifugal compressor, and the vertical axis represents pressure ratios of the centrifugal compressor by rate to a reference value.

Figure 6B:
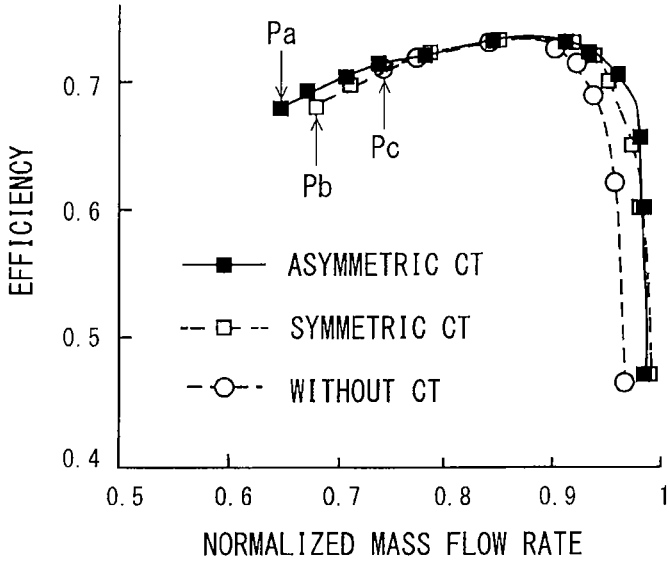
FIG. 6B is a graph for a comparison of efficiency among the centrifugal compressor provided with an asymmetric casing treatment according to Embodiment 1, a centrifugal compressor provided with a conventional symmetric casing treatment and a centrifugal compressor without a casing treatment.

FIG. 6B illustrates efficiency of the centrifugal compressor with reference to flow rates. In FIG. 6B, the horizontal axis represents normalized values of the flow rates to the centrifugal compressor, and the vertical axis represents efficiency of the centrifugal compressor by rate to a reference value.

Herein, the efficiency of the centrifugal compressor can be represented by the following Expression 1:

$$\eta = \frac{\text{energy used for pressure raise}}{\text{energy supplied to system}} = \frac{C_p T_{1t}\left\{\left(\frac{P_{2t}}{P_{1t}}\right)^{\frac{\gamma-1}{\gamma}} - 1\right\}}{C_p(T_{2t} - T_{1t})} \quad \text{[Expression 1]}$$

In this expression, $C_p$ denotes a constant pressure specific heat, $T_{1t}$ denotes a temperature on an inlet side of the centrifugal compressor, $T_{2t}$ denotes a temperature on an outlet side of the centrifugal compressor, $P_{1t}$ denotes a pressure on the inlet side of the centrifugal compressor, $P_{2t}$ denotes a pressure on the outlet side of the centrifugal compressor, and $\gamma$ denotes a ratio of specific heat.

In FIG. 6A and FIG. 6B, black square marks and the curve of the solid line passing through these square marks indicate the example of Embodiment 1 (i.e., the centrifugal compressor including an asymmetric casing treatment). In FIG. 6A and FIG. 6B, the casing treatment is abbreviated as CT. In FIG. 6A and FIG. 6B, open square marks and the curve of the dot-and-dash line passing through these square marks indicate the case of a conventional centrifugal compressor (i.e., a centrifugal compressor with a symmetric casing treatment) including a back-flow channel where the axial-direction positions of the suction ring groove 9*a* are constant at circumferential-direction positions. In FIG. 6A and FIG. 6B, open round marks and the curve of the dashed line passing through these round marks indicate the case of a centrifugal compressor without a back-flow channel (i.e., a centrifugal compressor without casing treatment).

In FIG. 6A and FIG. 6B, Pa denotes a limit operating point on a small flow-rate side where surge does not occur in the example of the present invention, Pb denotes a limit operating point on a small flow-rate side where surge does not occur in the centrifugal compressor including a symmetric casing treatment, and Pc denotes a limit operating point on a small flow-rate side where surge does not occur in the centrifugal compressor without a casing treatment. These limit operating points Pa, Pb and Pc show that the example of the present invention enables further expansion of a stable operating range. That is, the centrifugal compressor including a symmetric casing treatment extends a stable operating range free from surge (flow rate range) by 7.7% from that of the centrifugal compressor without a casing treatment, and the example of the present invention further extends the stable operating range free from surge (flow rate range) by 3.3% from that of the centrifugal compressor with the symmetric casing treatment.

As is understood from FIG. 6B, the efficiency of the example of the present invention is not degraded as compared with that of the centrifugal compressor with the symmetric casing treatment.

[Embodiment 2]

The following describes a centrifugal compressor 10 according to Embodiment 2 of the present invention. Embodiment 2 is the same as in the aforementioned Embodiment 1 except for the following description.

Instead of asymmetric distribution of the axial-direction positions of the suction ring groove 9*a* in the circumferential direction with reference to the rotational axis, in Embodiment 2, the distribution in the circumferential direction of the width of the suction ring groove 9*a* is asymmetric with reference to the rotational axis.

Figure 7A:
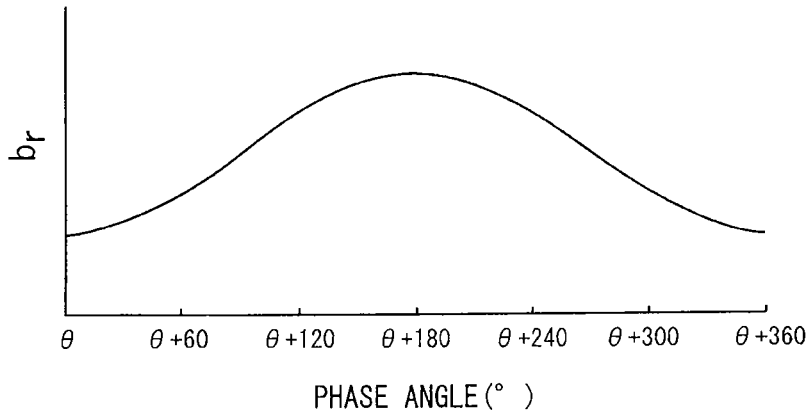
FIG. 7A illustrates distribution of a width $b_r$ of a suction ring groove.

FIG. 7A illustrates the width (i.e., the aforementioned $b_r$) of the suction ring groove 9*a* at the circumferential-direction positions to reduce the non-uniformity of fluid pressure distribution illustrated in FIG. 4. In FIG. 7A, the horizontal axis represents a phase angle (i.e., circumferential-direction position) around the rotational shaft 3, and the vertical axis represents a width $b_r$ of the suction ring groove 9*a*. As for the phase angles of FIG. 7A, FIG. 2 illustrates the position of 0° and the position of $\theta$.

Similarly to Embodiment 1, in Embodiment 2, the suction ring groove 9*a* having $b_r$ as in FIG. 7A reduces the non-uniformity of the fluid pressure distribution in the circumferential direction at the pressure-distribution-to-be-modified axial-direction position. Therefore, phenomena such as fluid separation, stall and surge can be prevented more effectively. As a result, a stable operating range of the centrifugal compressor 10 can be more extended.

[Example]

Figure 7B:
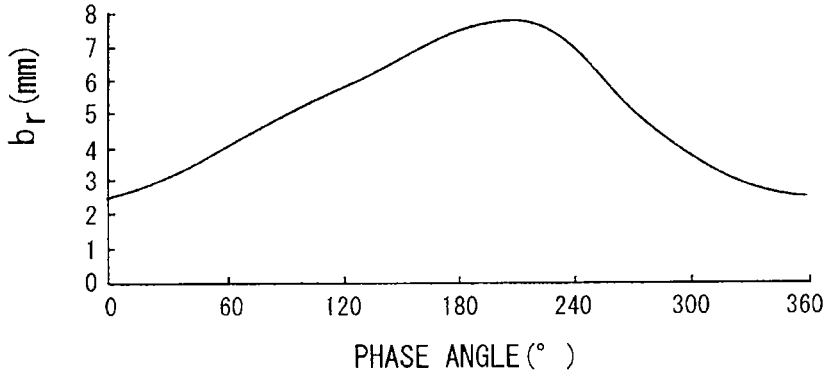
FIG. 7B illustrates optimum distribution of a width $b_r$ of a suction ring groove.

FIG. 7B illustrates optimum distribution of $b_r$ obtained by numerical simulation. In this numerical simulation, the parameters indicating the structure of the back-flow channel are set as $S_r$=5 mm, $S_f$=15.0 mm, $b_f$=10.0 mm, $b_b$=13.0 mm, $h_b$=8.0 mm and the starting phase angle $\theta$=0°.

Figure 8A:
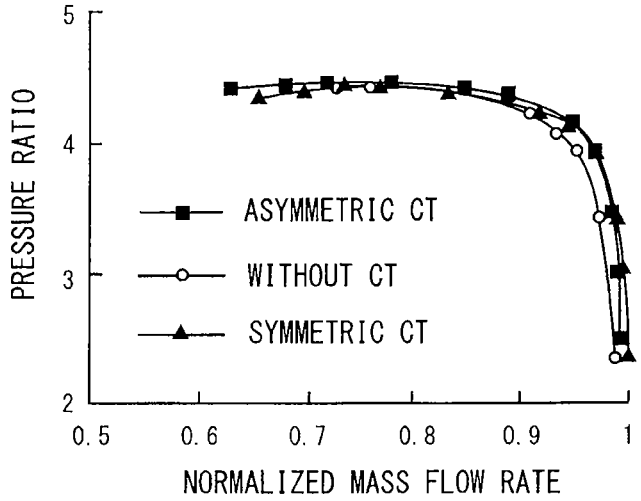
FIG. 8A is a graph for a comparison of pressure ratio among the centrifugal compressor provided with an asymmetric casing treatment according to Embodiment 2, a centrifugal compressor provided with a conventional symmetric casing treatment and a centrifugal compressor without a casing treatment.

FIG. 8A illustrates pressure ratios of the centrifugal compressor with reference to flow rates. In FIG. 8A, the horizontal axis represents normalized values of the flow rates to the centrifugal compressor, and the vertical axis represents pressure ratios of the centrifugal compressor by rate to a reference value.

Figure 8B:
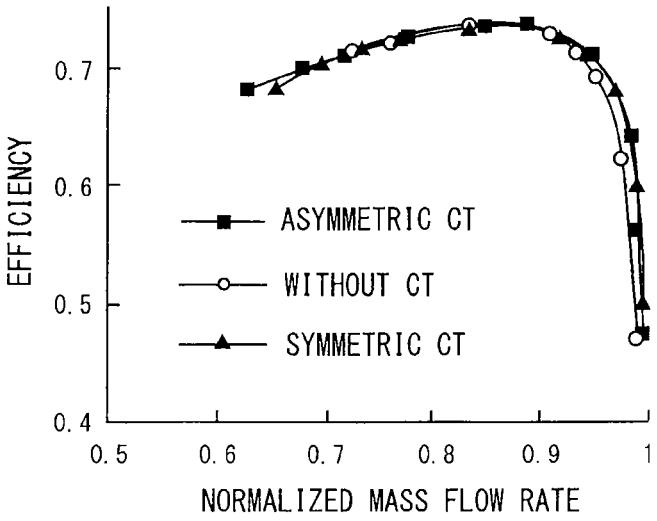
FIG. 8B is a graph for a comparison of efficiency among the centrifugal compressor provided with an asymmetric casing treatment according to Embodiment 2, a centrifugal compressor provided with a conventional symmetric casing treatment and a centrifugal compressor without a casing treatment.

FIG. 8B illustrates efficiency of the centrifugal compressor with reference to flow rates. In FIG. 8B, the horizontal axis represents normalized values of the flow rates to the centrifugal compressor, and the vertical axis represents efficiency of the centrifugal compressor by rate to a reference value.

In FIG. 8A and FIG. 8B, black square marks and the curve of the solid line passing through these square marks indicate the example of Embodiment 2 (i.e., the centrifugal compressor including an asymmetric casing treatment). In FIG. 8A and FIG. 8B, the casing treatment is abbreviated as CT. In FIG. 8A and FIG. 8B, black triangle marks and the curve of the solid line passing through these triangle marks indicate the case of a conventional centrifugal compressor including a back-flow channel where the axial-direction positions of the suction ring groove 9*a* are constant at circumferential-direction positions (i.e., a centrifugal compressor with a symmetric casing treatment). In FIG. 8A and FIG. 8B, open round marks and the curve of the solid line passing through these round marks indicate the case of a centrifugal compressor without a back-flow channel (i.e., a centrifugal compressor without casing treatment).

As is understood from FIG. 8A and FIG. 8B, the centrifugal compressor provided with an asymmetric casing treatment according to the example of the present invention can extend a stable operating range while substantially keeping the same efficiency as compared with the centrifugal compressor provided with a symmetric casing treatment and the centrifugal compressor without a casing treatment.

The present invention is not limited to the aforementioned embodiments, and can be modified variously in the range without departing from the scope of the present invention.

DESCRIPTION OF REFERENCE NUMERALS

3: rotational shaft, 4: scroll channel, 5: impeller 6: impeller full blade, 6*a*: impeller full blade leading edge, 6*b*: impeller full blade trailing edge, 7: casing 7*a*: inner face of casing, 8: impeller splitter blade, 8*a*: impeller splitter blade leading edge, 8*b*: impeller splitter blade trailing edge, 9: back-flow channel, 9*a*: suction ring groove, 9*b*: back-flow ring groove, 9*c*: ring guide channel 10: centrifugal compressor, 11: block member

The invention claimed is:

1. A method for manufacturing a casing of a centrifugal compressor including a rotational shaft that is rotatable, an impeller fixed to the rotational shaft, and the casing with inner face surrounding the impeller, wherein the impeller sends out drawn fluid to a scroll channel on an outer side in a radial direction of the rotational shaft for compression, the method comprising the steps of:

(1) providing a casing of a centrifugal compressor;

(2) forming a back-flow channel in the casing, wherein the back-flow channel returns fluid from a downstream position of an impeller full blade leading edge to an upstream position of the impeller full blade leading edge;

(3) forming, in a circumferential direction around the rotational shaft, as part of the back-flow channel, a suction ring groove that opens at the downstream position on an inner face;

(4) forming, in the circumferential direction, as part of the back-flow channel, a back-flow ring groove that opens at the upstream position on an inner face;

wherein a position in an axial direction of the rotational shaft is defined as an axial direction position, and distribution in the circumferential direction of the axial-direction position of the suction ring groove is asymmetric with reference to the rotational shaft, wherein as a position of the suction ring groove is shifted in the circumferential direction defining an angle θ with respect to the casing, the axial-direction position of the suction ring groove is first gradually shifted toward the opposite side of the impeller full blade leading edge over a first range in the circumferential direction and then gradually shifted toward the side of the impeller full blade leading edge over a second range in the circumferential direction so that the position of the suction ring groove makes one complete circle from an angle θ of 0° to 360° , and wherein the first range and the second range make the one complete circle, the step forms the suction ring groove such that a start point of the first range is selected to reduce non-uniformity of fluid pressure distribution in the vicinity of the impeller full blade leading edge upstream of the impeller full blade leading edge, compared to a centrifugal compressor having a symmetric self-recirculating casing treatment wherein a back-flow channel is symmetric with reference to a rotational shaft thereof.

2. A method for manufacturing a casing of a centrifugal compressor including a rotational shaft that is rotatable, an impeller fixed to the rotational shaft, and the casing with inner face surrounding the impeller, wherein the impeller sends out drawn fluid to a scroll channel on an outer side in a radial direction of the rotational shaft for compression, the method comprising the steps of:

(1) providing a casing of a centrifugal compressor;

(2) forming a back-flow channel in the casing, wherein the back-flow channel returns fluid from a downstream position of an impeller full blade leading edge to an upstream position of the impeller full blade leading edge;

(3) forming, in a circumferential direction around the rotational shaft, as part of the back-flow channel, a suction ring groove that opens at the downstream position on an inner face;

(4) forming, in the circumferential direction, as part of the back-flow channel, a back-flow ring groove that opens at the upstream position on an inner face;

wherein distribution in the circumferential direction of a width of the suction ring groove is asymmetric with reference to the rotational shaft, wherein as a position of the suction ring groove is shifted in the circumferential direction defining an angle θ with respect to the casing, the width of the suction ring groove first gradually increases over a first range in the circumferential direction and then gradually decreases over a second range in the circumferential direction so that the position of the suction ring groove makes one complete circle from an angle θ of 0° to 360° , and wherein the first range and the second range make the one complete circle, the step forms the suction ring groove such that a start point of the first range is selected to reduce non-uniformity of fluid pressure distribution in the vicinity of the impeller full blade leading edge upstream of the impeller full blade leading edge, compared to a centrifugal compressor having a symmetric self-recirculating casing treatment wherein a back-flow channel is symmetric with reference to a rotational shaft thereof.

3. The method according to claim 1, wherein the first range is larger in circumferential direction than the second range.

4. The method according to claim 2, wherein the first range is larger in circumferential direction than the second range.

* * * * *